US005354050A

United States Patent [19]

McCarthy

[11] Patent Number: 5,354,050

[45] Date of Patent: Oct. 11, 1994

[54] ALARM DEVICE FOR TEACHING THE CORRECT MECHANICS FOR THROWING A BASEBALL

[76] Inventor: Robert L. McCarthy, 357 Knight Way, La Canada, Calif. 91011

[21] Appl. No.: 221,782

[22] Filed: Apr. 1, 1994

[51] Int. Cl.[5] ..... A63B 69/40

[52] U.S. Cl. ..... 273/26 C; 273/187.2

[58] Field of Search ..... 273/26 C, 29 A, 187.2, 273/188 R, 189 R, 190 A, 214, 29 A

[56] References Cited

U.S. PATENT DOCUMENTS

| | | | |
|---|---|---|---|
| 2,994,533 | 8/1961 | Pupilla | 273/187.2 |
| 3,350,100 | 10/1967 | Garmines | 273/26 C |
| 3,638,011 | 1/1972 | Bain | 273/187.2 |
| 3,717,857 | 2/1973 | Evans | 273/187.2 |
| 3,811,684 | 5/1974 | Tredway | 273/187.2 |
| 3,860,245 | 4/1975 | Yamada | 273/187.2 |
| 4,193,065 | 3/1980 | Bittner | 273/187.2 |
| 4,488,726 | 12/1984 | Murray | 273/187.2 |
| 4,699,379 | 10/1987 | Chateau | 273/187.2 |
| 5,199,712 | 4/1993 | Hayle, Jr. | 273/187.2 |

*Primary Examiner*—Theatrice Brown

*Attorney, Agent, or Firm*—Edgar W. Averill, Jr.

[57] ABSTRACT

A training device for use by baseball players to help correct certain undesirable arm motion technique which might lead to catastrophic injury. The device utilizes one or more gravity-activated switches connected in a circuit within a case of a strap-on assembly. The gravity activated switches are oriented a specific way within the case, and the case strapped to a specific location of the arm so that certain undesirable arm motion will cause the gravity actuated switch to close and an alarm buzzer to sound. Conversely, the switch may be oriented so that the buzzer only sounds if the correct technique is practiced. The device is particularly useful in a preferred training method for baseball pitchers.

8 Claims, 3 Drawing Sheets

ALARM DEVICE FOR TEACHING THE CORRECT MECHANICS FOR THROWING A BASEBALL

FIELD OF THE INVENTION

The present invention pertains to a teaching and training device for athletes and, more particularly, to a device for training baseball pitchers the proper arm position during a throwing motion to reduce the chance of injury.

BACKGROUND OF THE INVENTION

Sports such as baseball often require repeated violent overhead arm motion which can lead to injury. The science of baseball pitching has been highly refined to reduce the chance of catastrophic injury. Sports therapists can identify the proper arm motion during a pitch which exposes the arm tendons and muscles to the least amount of stress. Quite understandably, it is not usual for the average young pitcher to receive intensive pitching instruction directed specifically toward preventing injury. Young boys have small hands so they hold a baseball with finger "under" the ball. A pitching motion starting this way can lead to injury. If a young pitcher continues throwing in this manner it becomes "muscle memory" and is extremely hard to correct. It is worse to practice something wrong than to not practice at all. The arm held alarm device of the present invention if used correctly over 4 to 6 weeks will develop "muscle memory" that can greatly reduce arm injury. "Muscle memory" using good mechanics is the goal of this invention. More likely, young pitchers learn from their fathers or little league baseball coach who may not properly emphasize the danger in using, or give repeated lessons to correct, improper technique. Furthermore, although injury normally happens as a result of chronic overuse, major arm injury has been known to occur after only a small number of pitches with the wrong technique, thus making beginning lessons even more critical. There have been numerous attempts to develop automated devices to help condition people to perform a particular activity in the correct manner. In particular, a number of devices to help bowlers learn the correct delivery and follow through are known. One such device is shown in U.S. Pat. No. 4,330,123 issued to Kleinerman wherein a device resembling a wrist watch is worn by the bowler. In one mode, the device includes an acceleration-activated switch and a gravity-activated switch which must be tripped in sequence upon a specified correct bowling motion for an annunciator to sound. In an alternative mode, the device houses two mercury switches connected to a circuit having a plurality of logic elements. Depending on the orientation of the wrist of the bowler, and disposition of the mercury switches, an annunciator is activated by one of two timers. The device is designed to signal the bowler when a correct backswing and follow-through have been achieved. Despite attempts to provide training devices for bowling and other activities, there is an need for an improved training device for teaching baseball pitchers the proper throwing motion to help avert career-disabling injury.

SUMMARY OF THE INVENTION

The present invention solves a long-felt need for an inexpensive and easy-to-use training method which reduces the chance of injury to baseball pitchers. The training method comprises wearing a training device at a particular orientation on the pitching arm and practicing pitching while attempting to avoid triggering a signaling element, such as an alarm buzzer, within the training device. Conversely, the training device can be worn such that proper throwing technique causes the signaling element to sound during a particular phase of the throwing motion.

In a preferred method, a gravity-activated switch has a fixed orientation within the training device, and the device is removable fastened to a specific portion of the pitching arm so that the switch is oriented with respect to that portion of the arm. In one embodiment, the switch is connected in a series circuit having a source of power, and the signalling element and is oriented with respect to the pitching arm so that the circuit remains open throughout a correct throwing motion. For example, the device may be strapped to the wrist at an orientation such that the gravity-activated switch remains open as long as the top surface of the wrist remains facing up, or at least does not come within five degrees of a vertical plane. Wearing the device in this manner will teach the pitcher the proper technique of keeping the fingers on top of the ball at all times as fingers behind or under the ball will cause injury to elbow and upper arm. In another embodiment, the switch is oriented with respect to the pitching arm so that the circuit closes during the entirety of, or during only a portion of, a correct throwing motion. Thus, for instance, the device may be strapped to the upper arm in an orientation such that the gravity-activated switch closes the series circuit, thus sounding the signalling element, when the elbow raises up higher than the shoulder. The elbow is supposed to be higher than the shoulder during a forward thrust phase of the pitching motion, and thus the pitcher can monitor the elbow position by wearing the training device, and adjust the throwing motion accordingly. The elbow below the shoulder is called "short arming". This invention will stop "short arming", which is the most disabling elbow injury. The arm should not go forward until the buzzer goes on.

The method of the present invention utilizes a preferred strap-on training device worn on an arm of an athlete to indicate a proper or improper athletic motion. More particularly, the training device includes one or more gravity-activated switches connected in series with a signalling element and a battery. The signalling element is preferably an electronic alarm buzzer or other auditory tone generating device. In one version of the device, the gravity-activated switch is oriented normal to a generally flat portion of the wrist of the throwing arm of the athlete. In a second version, the device is worn on the upper part of the throwing arm (above the elbow). The mercury switch is oriented parallel with the arm. In a third version, the training device includes two mercury switches oriented perpendicularly to each other and activated by selecting one of two buttons on the exterior of the device.

These and other advantages will become apparent from the following description and accompanying drawings.

DESCRIPTION OF THE PREFERRED EMBODIMENTS

Figure 1:
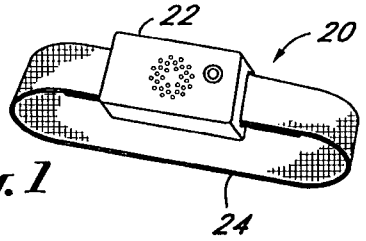
FIG. 1 is a perspective view of a strap-on training device of the present invention.
Figure 2:
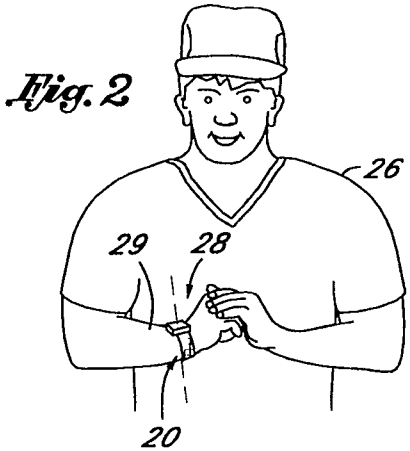
FIG. 2 is a view of an athlete wearing a wrist-mounted version of the strap-on training device of FIG. 1.

Referring to FIGS. 1 and 2 a strap-on training device 20 is shown. The device 20 includes a substantially flat central body or case 22 and a securing strap 24 configured much like a conventional wrist watch. The device 20 is shown in FIG. 2 being worn on the wrist of an athlete 26, and strapped to an upper arm region in FIG. 6, as will be described below. The present training device is especially suited for teaching young or inexperienced baseball pitchers the proper throwing motion to reduce the chance of injury. Although the description following will be kept within the baseball pitching environment, it will be appreciated by one of skill in the art of sports instruction that the present invention may also be applied in the training regimen of other athletes who practice similar violent overhead throwing motions. Such other activities include, for example, tennis, racquetball, football, etc.

Figure 3:
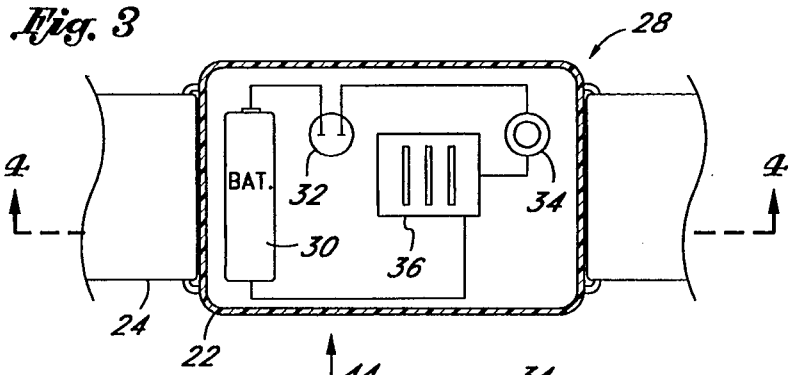
FIG. 3 is a cross-sectional view of the wrist-mounted version of FIG. 2 revealing the circuitry within.
Figure 4:
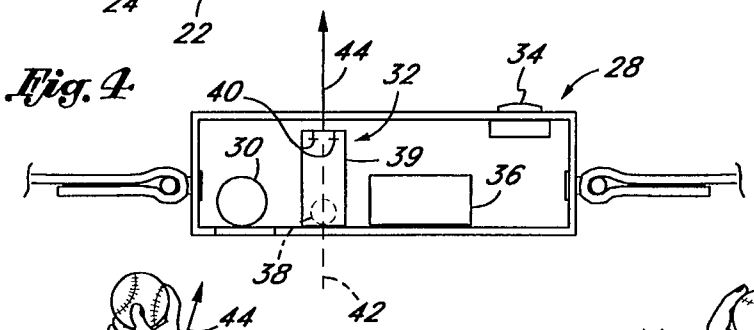
FIG. 4 is a cross sectional view of the wrist-mounted version of the training device along line 4—4 of FIG. 3 showing the orientation of a mercury switch.

Now with reference to FIGS. 2 through 4, a wrist-mounted version 28 of the training device 20 will be described. The wrist-mounted version 28 is designed to be strapped to the upper flat portion 29 of the wrist. FIG. 3 shows the simple internal circuitry of the wrist-mounted version 28 within the central body or case 22. A series circuit within the case 22 comprises a battery 30, a mercury switch 32, an on-off switch 34 and an alarm buzzer 36. As seen in FIG. 4, the mercury switch contains a small amount of mercury 38 within a cylindrical housing 39. At one end of the housing, two electrical terminals 40 form a physical gap in the series circuit. The mercury switch 32 is oriented within the central case 22 so that a central axis 42 lies normal to the generally flat central case. As seen in FIG. 4, with the device 28 held upright, the mercury 38 resides at the opposite end of the mercury switch from the terminals 40 and thus the circuit is open.

A ray or vector 44 extending from the terminal 40 end of the housing 39 of the device 28 must be directed upward for the mercury 38 to remain at the opposite end of the housing from the terminals 40 so that the switch 32 stays open. As will be explained below with respect to FIGS. 5*a–5d*, a preferred method of pitching comprises wearing the wrist-mounted training device 28 such that the vector 44 is pointed upward during the backswing and entire power stroke of a throwing motion.

An entire traditional throwing motion for baseball pitching includes a wind-up, bringing the hands behind the head with the body starting forward, a coiling or tucking motion with the forward leg raised, breaking of the hands with the throwing arm swinging behind the pitcher, a forward stride combined with an upward cocking motion of the throwing arm, and finally a forward power thrust of the arm terminating in release of the ball and full extension or pronation. The critical portion of the entire throwing motion occurs from the backswing of the throwing arm and continues through to release of the ball. During this portion is when the greatest stresses to the arm are generated, and thus highest threat of injury realized.

Figure 5C:
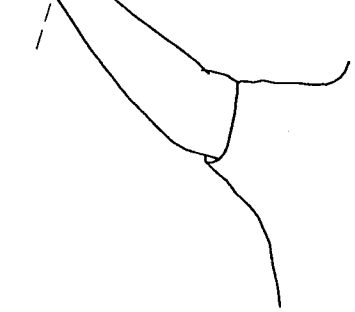
FIG. 5*a–d* are front elevational views of an athlete's arm during a portion of a throwing motion with the device of FIG. 3 strapped to the wrist.
Figure 5D:
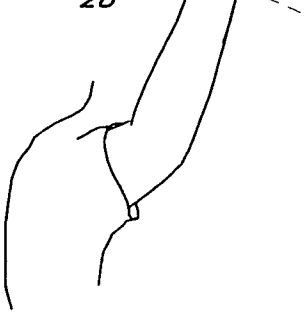
Figure 5B:
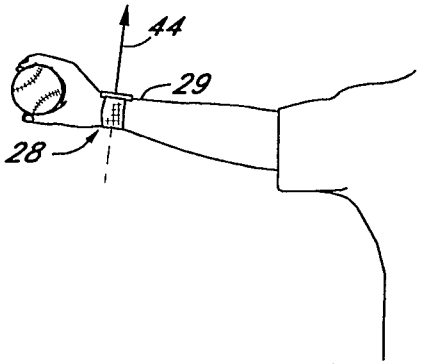
Figure 5A:
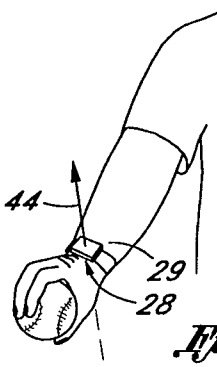

FIG. 5*a* shows the arm during the backswing after breaking of the hands and prior to the initial forward and upward motion. FIG. 5*b* shows the arm coming up after the backswing. FIG. 5*c* shows arm at the start of a forward thrust of a throwing motion. And finally, FIG. 5*d* illustrates the arm during the forward thrust of a throwing motion approaching release of the ball. In all these arm positions, the wrist-mounted training device 28 remains oriented on the wrist 29 such that the vector 44 points upward and the buzzer 36 stays silent. Any rotation of the wrist so that the fingers are under or on the side of the ball causes the alarm buzzer 36 to sound, alerting the pitcher to improper throwing technique. Desirably, the fingers remain on top of the ball so that the vector 44 makes at least a 5 degree upward angle with a horizontal plane to ensure the buzzer 36 does not sound. More preferably, and to best prevent injury, the fingers must be more completely on top of the ball and the device 28 is tuned to close the switch 32 when the vector 44 makes an upward angle of 30 degrees or less with a horizontal plane.

Figure 7:
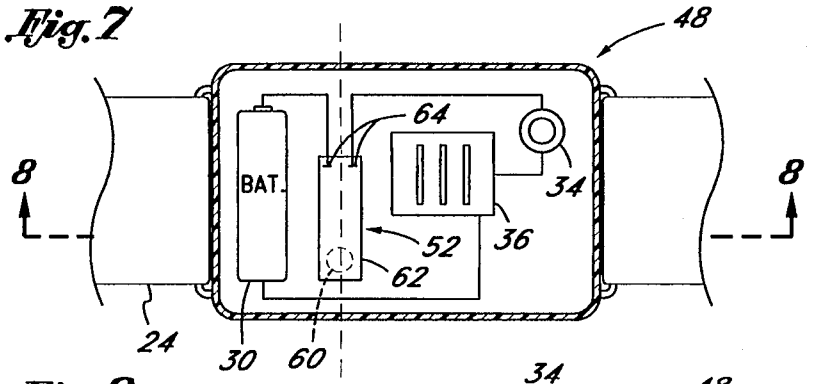
FIG. 7 is a cross sectional view of the upper arm-mounted version of FIG. 6 revealing the circuitry within.
Figure 8:
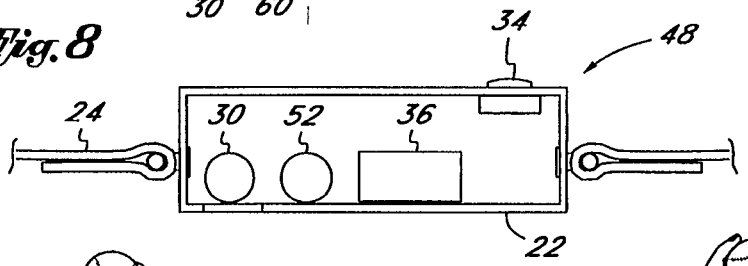
FIG. 8 is a cross sectional view of the upper arm-mounted version along line 8—8 of FIG. 7 showing the orientation of a mercury switch.
Figure 6:
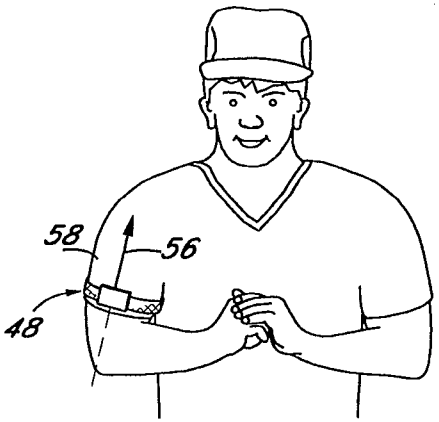
FIG. 6 is a view of an athlete wearing an upper arm-mounted version of the strap-on training device of FIG. 1.

An alternative training device 48 of the present invention is shown in FIGS. 6, 7 and 8. This embodiment is designed to be worn on an upper arm region 50 of an athlete. The device is similar to that shown and described with reference to 3 and 4 with the orientation of a mercury switch 52 being modified. Specifically, the mercury switch lies parallel to the generally flat central case 22 and generally perpendicular to the direction in which the securing strap 24 lies. A central axis 54 extends through the switch 52 and projects from one end as a vector 56 pointing out one side of the case 22. When worn on the upper arm 58 in a resting position as seen in FIG. 6, with the vector 56 pointing upward, the mercury 60 remains at the opposite end of the switch housing 62 from the terminal contacts 64.

Figure 9D:
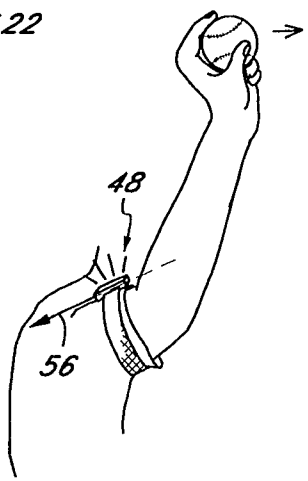
FIGS. 9*a–d* are front elevational views of an athlete's arm during a portion of a throwing motion with the device of FIG. 7 strapped to the upper arm.
Figure 9C:
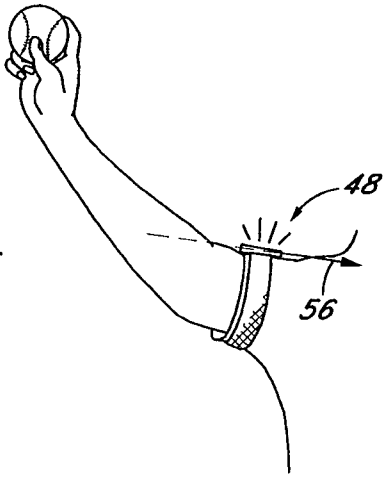
Figure 9B:
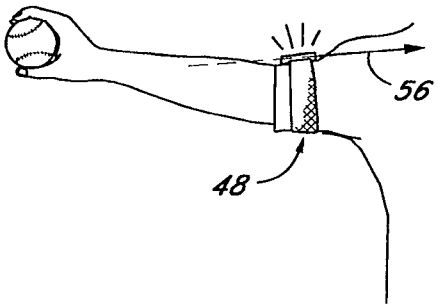
Figure 9A:
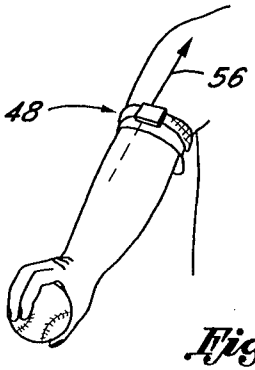

Now with reference to FIGS. 9*a–d*, a sequence of snap-shots of a pitchers throwing motion, identical to the snap-shots of FIGS. 5*a–d*, is shown. The alternative embodiment of the device, unlike the first embodiment, is designed to activate the buzzer during a crucial portion of the correct throwing motion. Specifically, the correct pitching motion includes maintaining the elbow above the shoulder during the forward thrust phase. To illustrate the function of the alternative embodiment, FIGS. 9*a* and 9*b* show the device with the vector 56 running from the elbow to the shoulder. In FIG. 9*b*, the vector 56 makes a slight downward angle with the horizontal so that the mercury switch 52 closes and the buzzer 36 sounds. Desirably, the upper arm-mounted device 48 is tuned to activate the alarm buzzer when the vector 56 lies at or below the horizontal plane. More preferably, the mercury switch is fluid-damped to effectively delay closing of the alarm circuit until the vector 56 makes at least a five degree downward angle with the horizontal. Thereafter, during the forward thrust phase, for proper technique, the device 48 is tilted so that the mercury 60 remains at the end of the housing 62 where the terminals 64 are located, and the switch stays closed. The buzzer 36 thus sounds during the entire forward thrust, as represented by the arm in FIGS. 9*b*–9*d*.

The wrist-mounted training device 28 of FIG. 3 and the upper arm-mounted device 48 of FIG. 7 can be worn simultaneously to combine the beneficial aspects of their proper technique signalling modes. In a particularly useful arrangement, the devices incorporate different auditory signalling means, such as an alarm buzzer and a whistle, so as to better distinguish their outputs.

Figure 10:
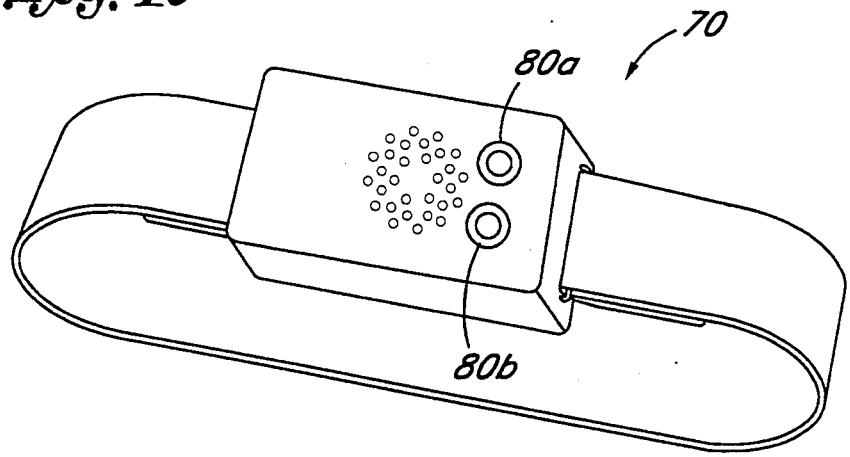
FIG. 10 is a perspective view of a dual function training device of the present invention.
Figure 11:
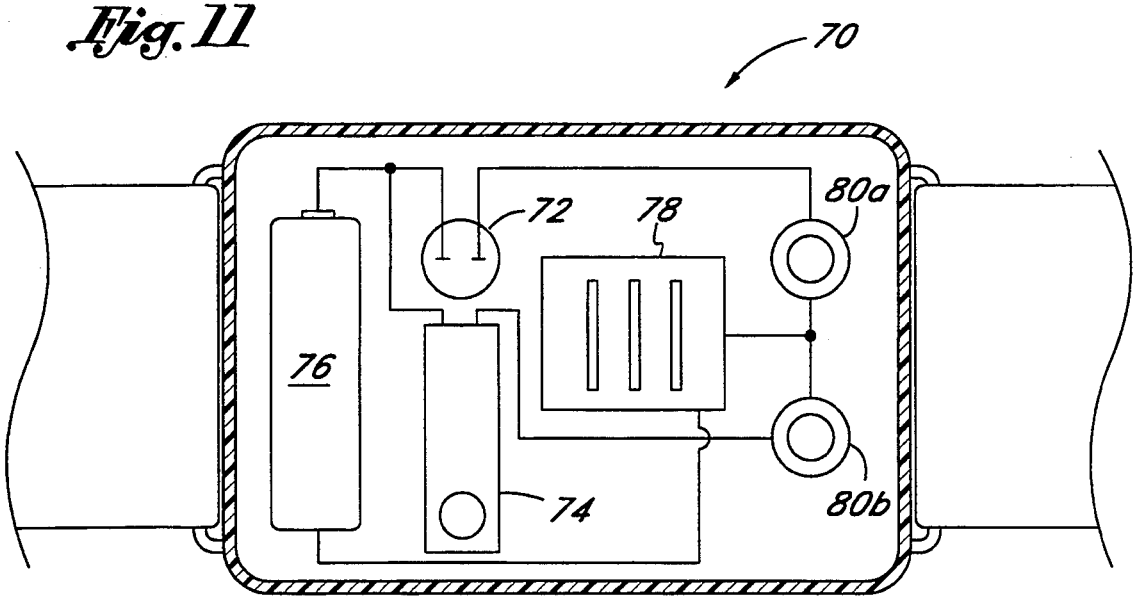
FIG. 11 is a cross-sectional view of the training device of FIG. 10 showing the circuitry within.

In a multi-purpose configuration of FIGS. 10 and 11, a combined wrist and upper arm training device 70 is shown. In this combined device 70, there are two mercury switches: one switch 72 oriented in the same manner as the mercury switch 32 of the wrist-mounted device 28 of FIG. 3, and the other switch 74 oriented identical to the switch 52 of the upper arm-mounted device 48 of FIG. 7. The device further includes a battery 76, an alarm buzzer 78, and two manually-activated switches 80*a*, 80*b*. The two switches 80 function as a single toggle switch, wherein depressing one selects one of the mercury switches 72 or 74 exclusive of the other, and visa versa. Thus, this combined device 70 can be worn either on the wrist or on the upper arm depending on which aspect of the pitching technique needs the work. The pitcher need only toggle the switches 80 and move the device 70 along his or her arm to change from the wrist to the upper arm, or visa versa. Of course, two of the devices described in FIGS. 10 and 11 can be worn at the same time to work on both the wrist and the upper arm technique, simultaneously.

Although the present invention has been described in terms of certain preferred embodiments, other embodiments are possible and the scope of the invention is to be defined by the following claims.

I claim:

1. A method of instruction for baseball pitching, comprising the steps of:

providing a training device having a central body and a circuit mounted therein, said circuit including at least a source of power, a gravity activated switch and an alarm connected in series;

fastening said training device to the wrist of an athlete at a specific orientation so that said gravity activated switch is open when a vector projecting from and normal to an upper surface of the wrist forms at least a five degree upward angle with a horizontal plane; and throwing a baseball utilizing the conventional backswing and forward thrust phases without closing said switch and activating said alarm between the instant the hands break and the release of the ball.

2. The method of claim 1 wherein said switch is a mercury switch and the method includes preventing said switch from closing.

3. The method of claim 1 wherein said switch is a fluid damped mercury switch and the method includes preventing said switch from closing.

4. The method of claim 1, further comprising the steps of:

providing a manually-activated switch in the series circuit; and temporarily disabling said circuit by opening said manually activated switch.

5. A method of instruction for baseball pitching, comprising the steps of:

providing a training device having a central body and a circuit mounted therein, said circuit including at least a source of power, a gravity activated switch and an alarm connected in series;

fastening said training device to an upper portion of the throwing arm of an athlete at a specific orientation so that said gravity activated switch is open when a vector projecting from the elbow to the shoulder on the throwing arm forms at least a five degree upward angle with a horizontal plane; and throwing a baseball so that said switch closes and activates said alarm during a forward thrust phase of a throwing motion.

6. The method of claim 5 wherein said switch is a mercury switch and the method includes preventing said switch from closing.

7. The method of claim 6 wherein said switch is a fluid damped mercury switch and the method includes preventing said switch from closing.

8. The method of claim 5, further comprising the steps of:

providing a manually-activated switch in the series circuit; and temporarily disabling said circuit by opening said manually activated switch.

* * * * *